US005564377A

United States Patent [19]

Azuma

[11] Patent Number: 5,564,377

[45] Date of Patent: Oct. 15, 1996

[54] INTAKE MANIFOLD

[75] Inventor: Satoshi Azuma, Ebina, Japan

[73] Assignee: Nissan Motor Co., Ltd., Yokohama, Japan

[21] Appl. No.: 432,851

[22] Filed: May 2, 1995

[30] Foreign Application Priority Data

May 9, 1994 [JP] Japan ..... 6-095331

[51] Int. Cl.[6] ..... F02M 35/116

[52] U.S. Cl. ..... 123/184.34; 123/184.42

[58] Field of Search ..... 123/184.31, 184.34, 123/184.42, 184.47, 184.38

[56] References Cited

U.S. PATENT DOCUMENTS

| | | | |
|---|---|---|---|
| 4,823,748 | 4/1989 | Ampferer et al. | 123/184.31 |
| 4,901,681 | 2/1990 | Pozniak et al. | 123/184.31 |
| 5,092,285 | 3/1992 | Beaber | 123/184.34 |
| 5,220,889 | 6/1993 | Ampferer et al. | 123/184.31 |
| 5,322,038 | 6/1994 | Urabe et al. | 123/184.31 |

FOREIGN PATENT DOCUMENTS

| | | | |
|---|---|---|---|
| 61-23648 | 7/1986 | Japan . | |
| 62-111966 | 7/1987 | Japan | 123/184.34 |
| 4-134129 | 5/1992 | Japan | 123/184.34 |
| 4-136420 | 5/1992 | Japan | 123/184.47 |
| 6-2625 | 1/1994 | Japan | 123/184.31 |
| 6-81659 | 3/1994 | Japan | 123/184.31 |

*Primary Examiner*—David A. Okonsky
*Attorney, Agent, or Firm*—Foley & Lardner

[57] ABSTRACT

An intake manifold of a multi-cylinder engine comprises a lower branch and an upper branch both having an identical number of pipe elements. One end of the lower branch is connected to a plurality of intake ports of an engine cylinder head, and at the other free end, the pipe elements are arranged in a row. The upper branch overhangs one side of the cylinder head. One end of the upper branch is connected to a collector disposed above the cylinder head, and at the other free end, the pipe elements are arranged in a row. Flanges are formed around the pipe elements at the free ends of these branches. First holes are provided at positions nearby the two ends of the row. Second holes are formed on an edge of the flanges, these holes being offset from the line joining the first holes on the opposite side to the aforesaid side of the cylinder head. A sealing member is inserted between the flanges, and the flanges are joined tightly together by bolts via these holes. Ample support and sealtightness resistant to vibration are thereby obtained by this construction.

6 Claims, 6 Drawing Sheets

INTAKE MANIFOLD

FIELD OF THE INVENTION

This invention relates to a supporting structure for an intake manifold of an automobile engine.

BACKGROUND OF THE INVENTION

Intake manifolds for multi-cylinder engines comprise a branch with a plurality of pipe elements for supplying air, originally guided from an air cleaner to a collector, to each cylinder of the engine. It is known that if the length of this branch is increased, the intake efficiency is improved due to the inertia of the air.

However, in the case of a V-type automobile engine having two banks of cylinders, installation space is limited, so in manifolds having a long branch, an arrangement is adopted wherein the manifold for example forms an overhang above one of the banks and a lateral surface of the cylinder head in each bank and a collector above the bank are connected by a curved branch.

Long manifolds having an overhang tend to vibrate easily, so special care must be paid to the structure that is used to support them.

In Jikkai Sho 62-111966 published by the Japanese Patent Office in 1987, for example, an intake manifold for a V-shaped engine is split into a lower branch having an inverted V-shape so as to connect intake ports of two banks, and an upper branch with an overhang connected to a collector above one bank. Flanges on the ends of each of these branches are fixed by means of bolts.

In this case, on the side on which the upper branch overhangs, the area above the flanges is covered by the plurality of pipe elements forming the branch, so lack of space makes it difficult to pass bolts through the flanges. Some of the pipe elements are therefore bent laterally, in order to make gaps between adjacent pipe elements, and the bolts are passed through the flanges via these gaps. Hence, the bolts can be disposed at effectively equidistant intervals on the flanges, and the lower branch can be rigidly joined to the upper branch.

Instead of rigidly joining the lower branch and upper branch in this way, Jikko Sho 61-23648 published by the Japanese Patent Office in 1986 discloses a structure wherein an intake manifold is elastically supported by a shock-absorbing gasket and a rubber shock absorber.

According to this construction, a lower branch of the intake manifold connected to the cylinder head and an upper branch extending above the cylinder head are bolted together after interposing a shock-absorbing gasket. The other end of the upper branch is supported by a bracket provided in the cylinder head via a rubber shock absorber.

By elastically supporting the intake manifold instead of increasing the rigidity of the support, the sealtightness of connecting parts can be maintained using a relatively small number of bolts. Furthermore, the elastic parts prevent cracks in the manifold or damage of associated parts caused by engine vibration, and also reduce the noise of vibration.

Hence, if it is desired to make a rigid connection between the lower branch and upper branch, a large number of bolts are required to maintain rigidity, the rigidity of the branches themselves must be increased, and as the number of bosses through which the bolts pass must also be increased, the casting of the branches is rendered more difficult and their weight increases.

In the latter construction, on the other hand, a plurality of shock-absorbing supports are required, and costs are higher due to the increased number of parts. The provision of a plurality of shock-absorbing supports moreover imposes design limitations.

SUMMARY OF THE INVENTION

It is therefore an object of the invention to simplify an intake manifold and its supports, and make the assembly more lightweight.

It is a further object of the invention to increase the durability of the supporting structure of an intake manifold.

In order to achieve the above objects, this invention provides an intake manifold for such a multi-cylinder engine that has a cylinder head, intake ports formed on the cylinder head and a collector disposed above the cylinder head. The intake manifold connects the collector and the intake ports and comprises a lower branch having a plurality of pipe elements of which the lower ends are connected to the intake ports, and the elements are arranged in a row at their other, free end, an upper branch having a plurality of pipe elements which overhang one side of the cylinder head and of which the upper ends are connected to the collector, and the elements are arranged in a row at their other, free end, a flange formed around the pipe elements at the free end of the lower branch, a flange formed around the pipe elements at the free end of the upper branch, an elastic seal member inserted between the flanges, first holes formed in the flanges at positions nearby the two ends of the row, second holes formed on an edge of the flanges at positions offset with respect to the line joining the first holes on the opposite side of the aforesaid side of the cylinder head, and bolts joining these flanges together via these holes.

It is preferable that the deformation of the seal member due to the bolts applied to the first holes is set to be larger than the deformation of the seal member due to the bolts applied to the second holes.

It is further preferable that the bolts applied to the first holes are stud bolts, and the bolts applied to the second holes are stepped bolts.

It is still further preferable that the manifold further comprises a washer made of an elastic member inserted between the stepped bolt and the flange.

It is still further preferable that the first holes are formed at positions displaced toward the collector from the center line of the row.

The details as well as other features and advantages of this invention are set forth in the remainder of the specification and are shown in the accompanying drawings.

DESCRIPTION OF THE PREFERRED EMBODIMENTS

Figure 1:
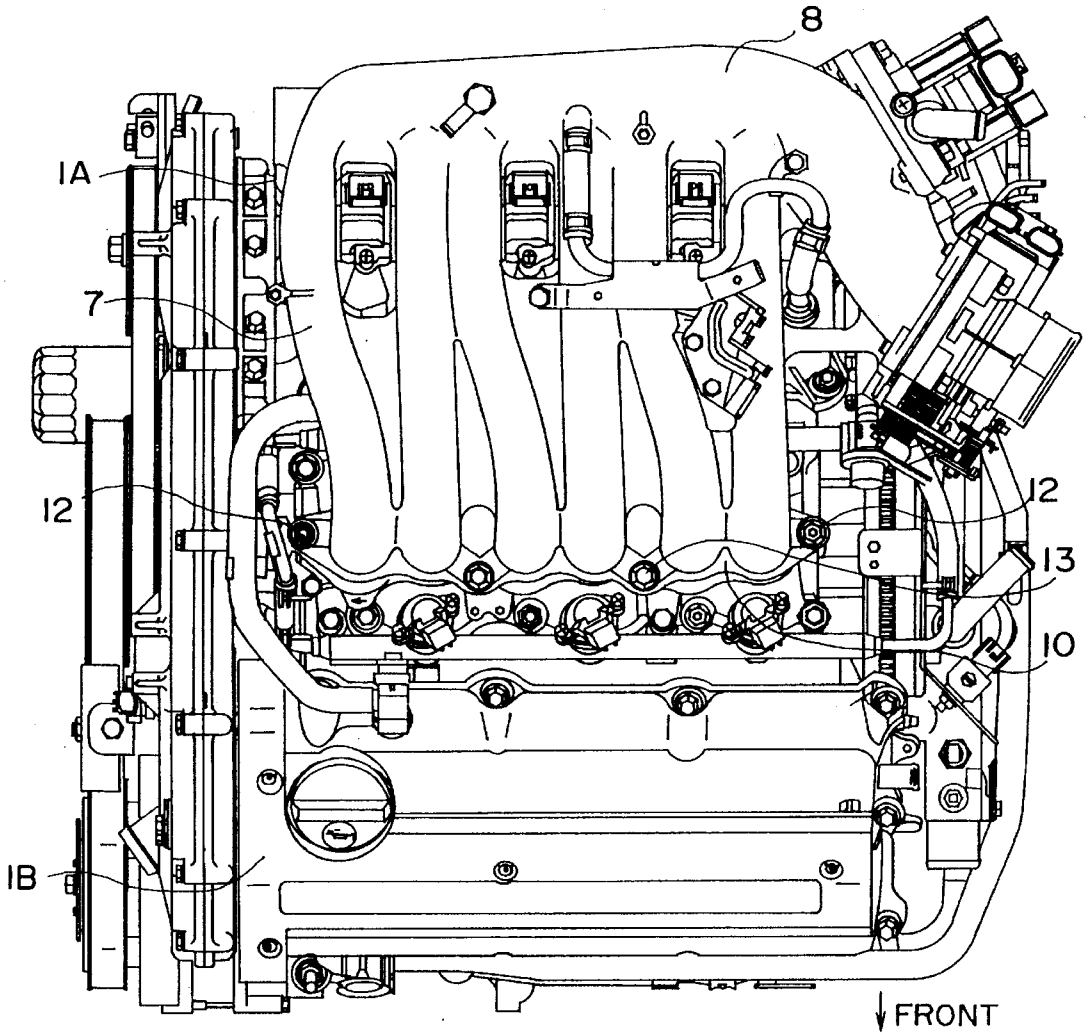
FIG. 1 is a plan view of an engine provided with an intake manifold according to this invention.

Referring to FIG. 1 of the drawings, a V-type six cylinder automobile engine has cylinders arranged in tow separate banks 1A and 1B. The engine has a collector 8 above the bank 1A, and air is aspirated into the cylinders from the collector 8 via an intake manifold 5.

Figure 2:
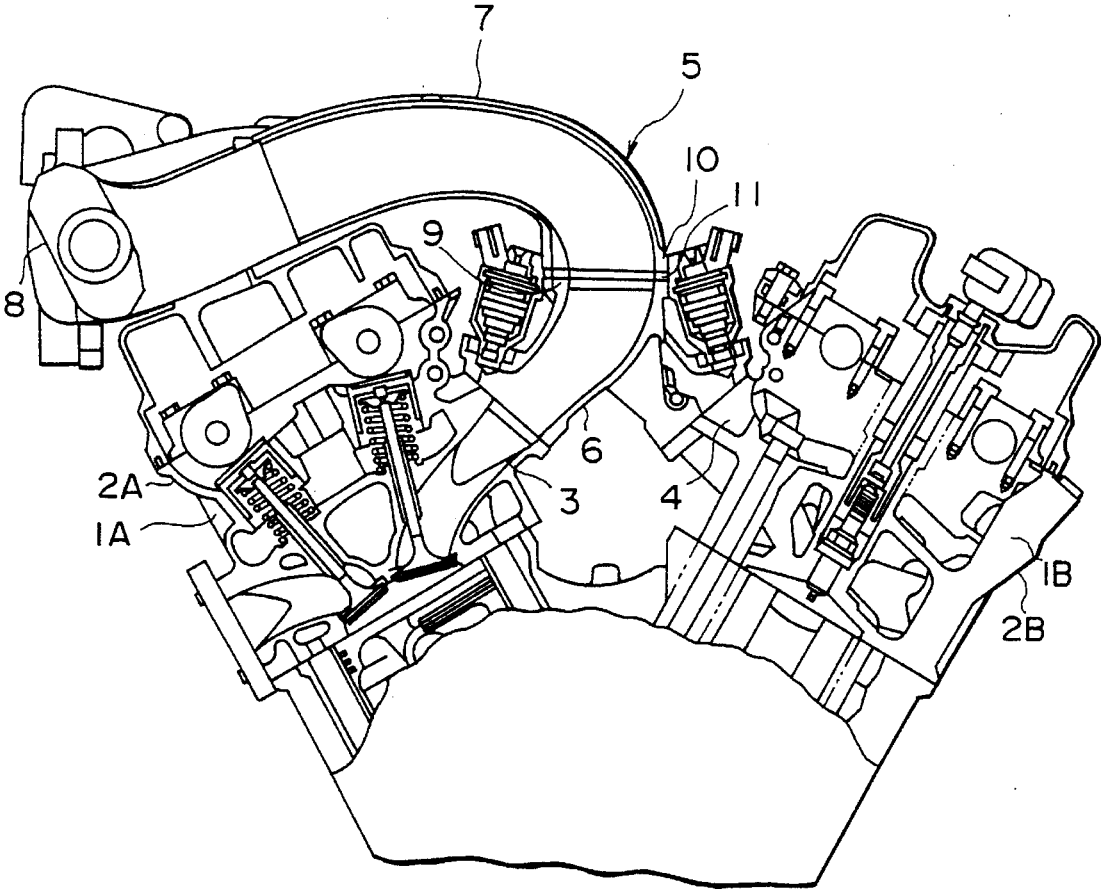
FIG. 2 is a vertical sectional view of the engine.

The bank 1A is provided with a cylinder head 2A and the bank 1B is provided with a cylinder head 2B, as shown in FIG. 2. Intake ports 3 and 4 are each provided at three positions on lateral, opposite faces of the cylinder heads 2A, 2B. The engine is disposed in an engine compartment, the passenger compartment of the automobile being on the top of FIG. 1, and the front end of the automobile being on the bottom of FIG. 1.

The intake manifold 5 comprises a lower branch 6 connected to the intake ports 3 and 4, and an upper branch 7 that connects with this lower branch 6 and the collector 8. The upper branch 7 has a curved, longitudinal shape, and is connected to the collector 8 such that it overhangs the cylinder head 2A.

The lower branch 6 comprises six pipe elements, these pipe elements being connected alternately to the intake ports 3 and 4. The lower branch 6 therefore has an inverted V-shape of which the lower part opens to the left and right. A flange 9 is formed in a one-piece construction with the lower branch 6 at its upper end where the openings of the six pipe elements are arranged in a row.

The upper branch 7 has six pipe elements arranged parallel to and in close contact with each other, the pipe elements curving over the cylinder head 2A so as to connect with the connector 8 from the side. An air cleaner (not shown) for filtering outside air is connected to the connector 8 via an intake duct. A flange 10 having the same shape as the flange 9 is formed at the lower end of the upper branch 7.

The lower branch 6 and upper branch 7 enclose a rubber gasket 11 having effectively the same shape between the flanges 9 and 10, this gasket acting as an elastic seal, and are fixed by means of two stud bolts 12 and two stepped bolts 13. The step bolt 13 is a bolt having a step for limiting the compression force acting on the gasket 11.

Figure 3:
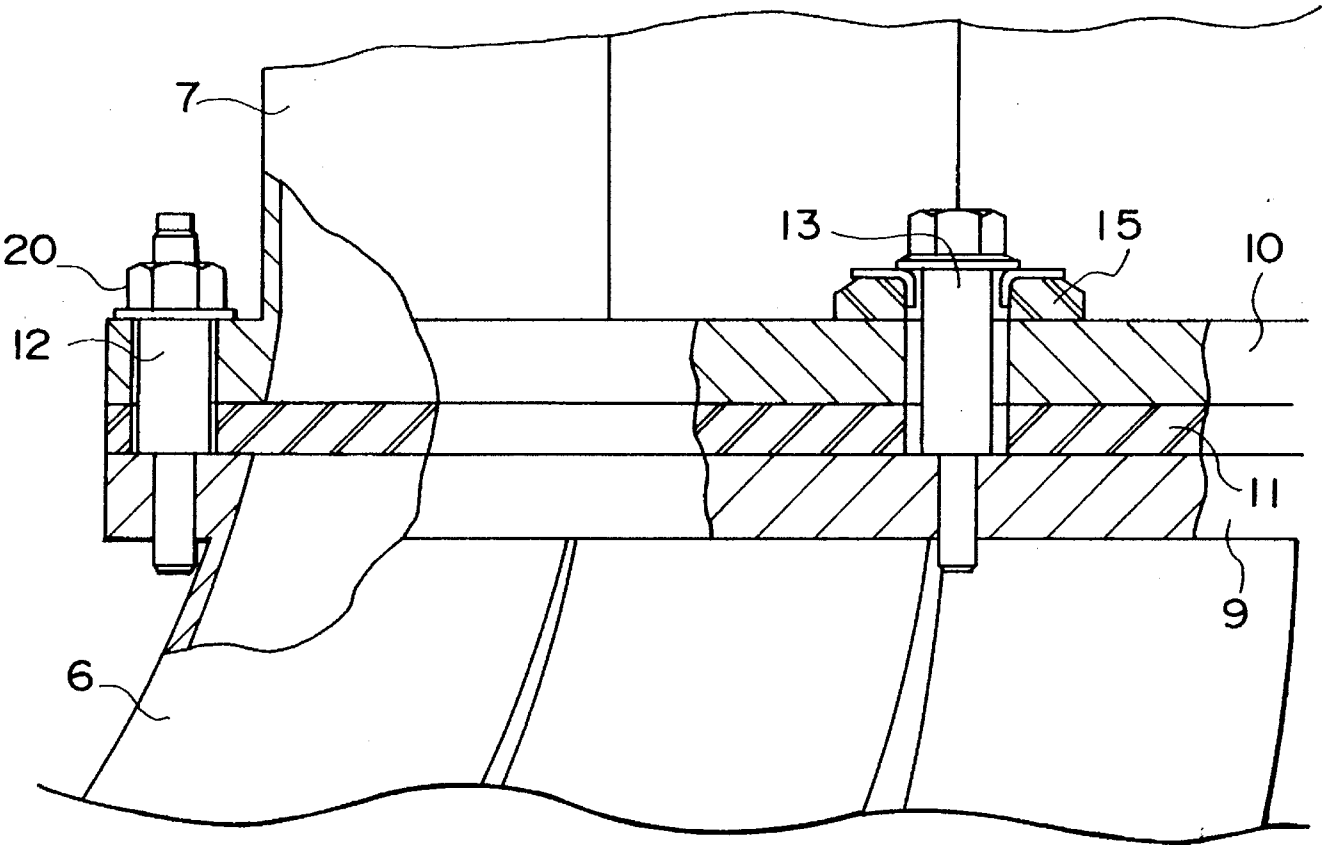
FIG. 3 is a sectional view through flange connections of the intake manifold according to this invention.

The stud bolts 12 are used in first holes provided in the flanges 9 and 10 at positions corresponding to the two outer sides of the row of six pipe elements. As shown in FIG. 3, the end of each of the stud bolts 12 screws into a first hole formed in the flange 9, and a first hole is pierced in the flange 10 so that a small clearance from the stud bolt 12 remains. A nut 20 screws onto the end of the stud bolt 12 that projects above the flange 10. When this nut is tightened, the flanges 9 and 10 are held firmly together with the gasket 11 between them. The first holes are formed at positions slightly displaced toward the collector 8 from the center line of the row of six pipe elements, i.e. they are offset towards the overhang of the upper branch 7.

In order to make use of the stepped bolts 13, second holes are formed at symmetrical positions with a predetermined interval on the edges of the flanges 9 and 10, offset from the line joining the two stepped bolts 12 in the opposite direction to the overhang of the upper branch 7. The stepped bolts 13 and stud bolts 12 have a positional relation on a fiat plane such that they form the apices of a trapezoid with equal legs. It is still more preferable that the second holes are provided at three equidistant positions along the row of six pipe elements.

The end of each of the stepped bolts 13 screws into a second hole formed in the flange 9, and a second hole is pierced in the flange 10 such that a small clearance from the stepped bolt 13 remains. A rubber washer 15 is inserted between the head of the stepped bolt 13 above the flange 10, and the flange 10.

By inserting this rubber washer 15 between the stepped bolt 13 and flange 10, when the bolts 12 and 13 are tightened equally, the deformation of the rubber gasket 11 due to the stud bolts 12 is larger than the deformation of the gasket 11 due to the stepped bolts 13 by an amount equal to the deformation of the washer 15.

A bending moment acts on the join between the lower branch 6 and upper branch 7 depending on the weight of the collector 8 and the upper branch 7 which has the overhang. This bending moment is effectively supported by the tensile resistance of the two stepped bolts 13 situated on the opposite side to the overhang.

When the intake manifold 5 vibrates due to the vibration of the engine, the rubber gasket 11 inserted between the flanges 9 and 10, elongates and contracts, and thereby prevents an excessive bending moment from acting on the stud bolts 12 and stepped bolts 13 while maintaining sealtightness.

Further, as the rubber washer 15 interposed between the stepped bolts 13 and flange 10 deforms flexibly and elastically together with the rubber gasket 11 in accordance with the variation of load, the joined surfaces of the flanges retain a high degree of sealtightness.

In the intake manifold 5, as the stud bolts 12 are disposed nearer the collector 8 than the center line of the branch passage of the flange 9, and the stepped bolts 13 are disposed on the opposite side of the collector 8, bolts are disposed on both sides of the center line of the flanges 9 and 10. Vibrations of the upper branch 7 can therefore be effectively prevented by a small number of bolts.

Due to the vibration of the manifold 5, a shear force acts between the flanges 9 and 10. As hereintoforementioned, the compression of the gasket 11 is higher in the vicinity of the stud bolts 12 disposed at the ends than in the vicinity of the stepped bolts 13, hence the frictional resistance exerted by the gasket 11 on the flanges 9 and 10 is greater in the vicinity of the stud bolts 12. This frictional resistance opposes the shear force due to the vibration, so the shear force acting on the stepped bolts 13 is lowered.

Further, as the stud bolts 12 have an upper and a lower thread, the spring constant with respect to vibrations in the shear direction is half of the spring constant of the stepped bolts 13 that have only one thread, so rotation and twisting due to vibration in the shear direction do not easily occur. Hence, high tightening force is maintained over a long period of time.

As the upper branch 7 has a form wherein the pipe elements are arranged close to each other and is not very highly curved, the air resistance in the passage is low, and high aspiration efficiency is obtained due to the inertial effect of the intake air.

Further, as the upper branch 7 formed in a one-piece construction like a wall, covers the lateral face and the upper area of the bank 1A disposed on the side of the passenger compartment, it effectively prevents the noise of the engine fuel injector, and of the intake and exhaust valves, from reaching the passenger compartment.

Figure 4:
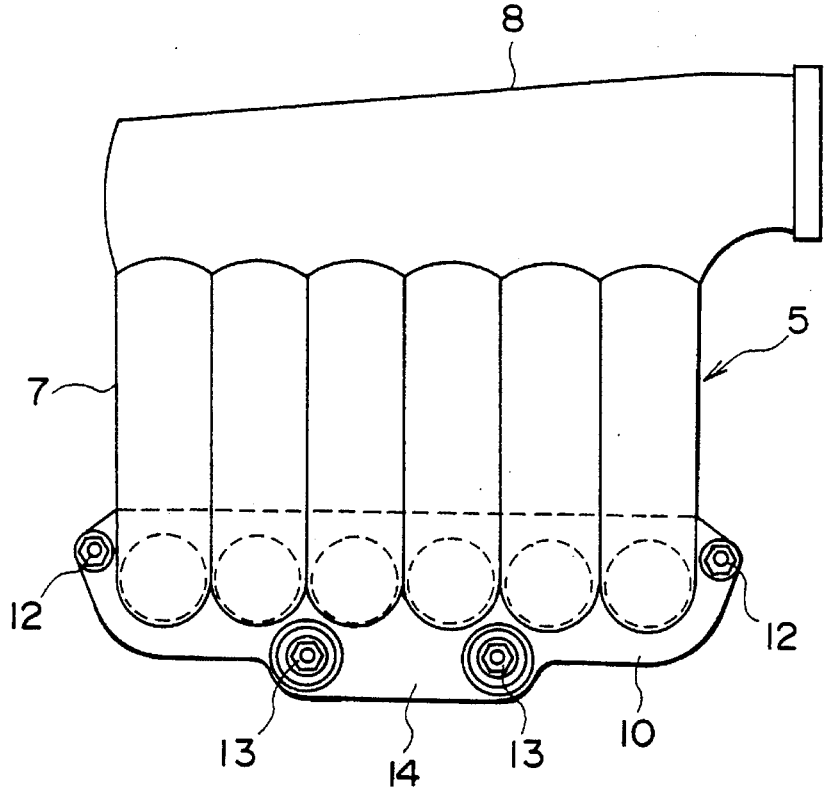
FIG. 4 is a plan view of an intake manifold according to a second embodiment of this invention.
Figure 5:
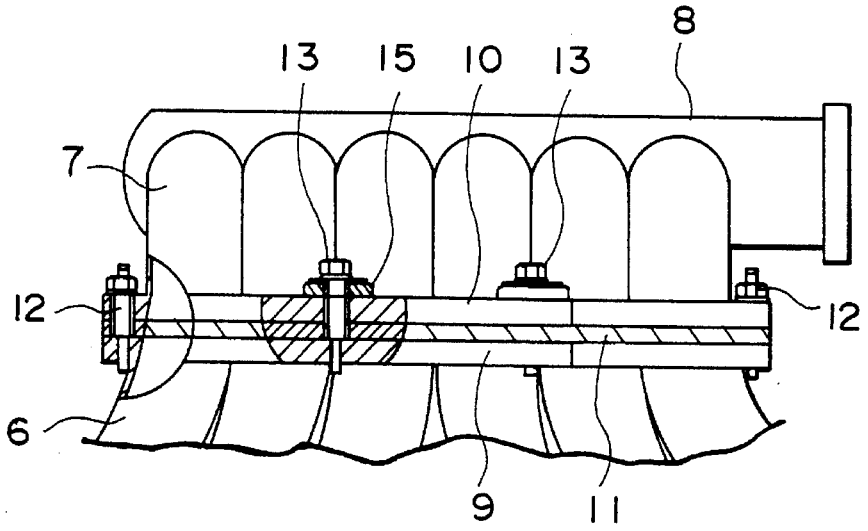
FIG. 5 is a side view of the intake manifold with a vertical sectional view of flanges, according to the second embodiment of this invention.

FIGS. 4 and 5 show a second embodiment of this invention.

According to this embodiment, the pipe elements forming the upper branch 7 are brought into close contact, and are formed in a straight line. This construction is possible due to the absence of bolts joining the flanges 9 and 10 below the pipe elements. By making the pipe elements straight, the intake resistance in the passage is further reduced, and an even greater improvement is obtained due to the inertial effect of intake air. Power is particularly enhanced when the vehicle is running at high speed.

In this embodiment, a lip 14 is provided on the flanges 9 and 10 on the opposite side to the overhang, and second holes are provided so as to install the stepped bolts 13. A bending moment acts on the flanges 9 and 10 according to the weight of the collector 8 that has an overhang and the upper branch 7. By installing the stepped bolts 13 on this lip 14, the distance between the stepped bolts 13 and the point of action of the bending moment is increased, the stress acting on the stepped bolts 13 is smaller, the load on the stepped bolts is reduced, and durability is improved.

Figure 6:
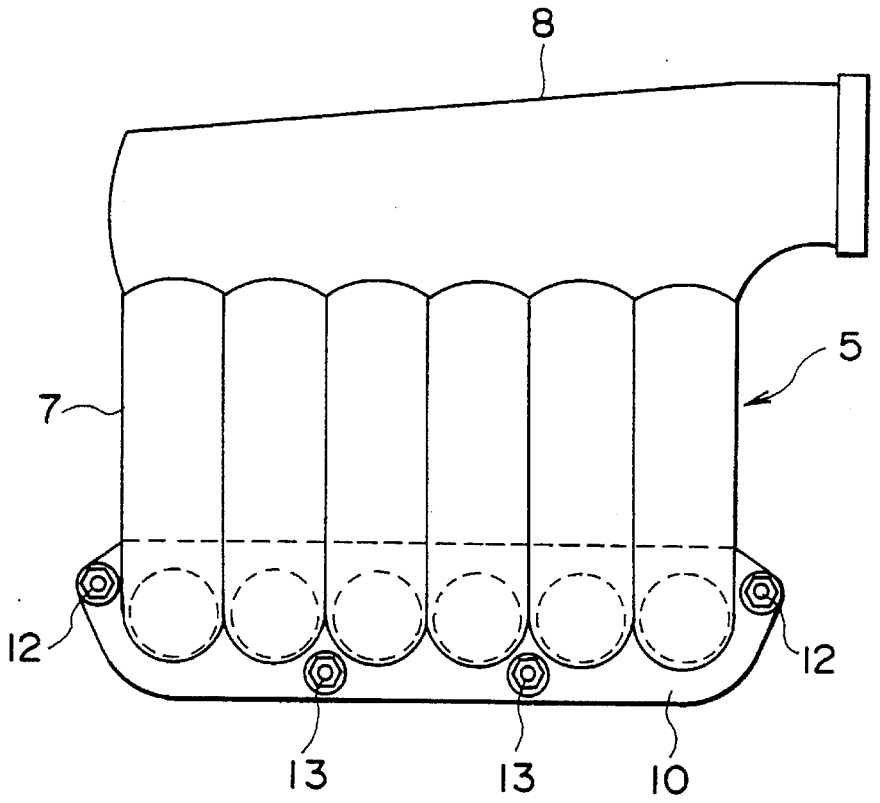
FIG. 6 is similar to FIG. 4, but showing a third embodiment of the invention.
Figure 7:
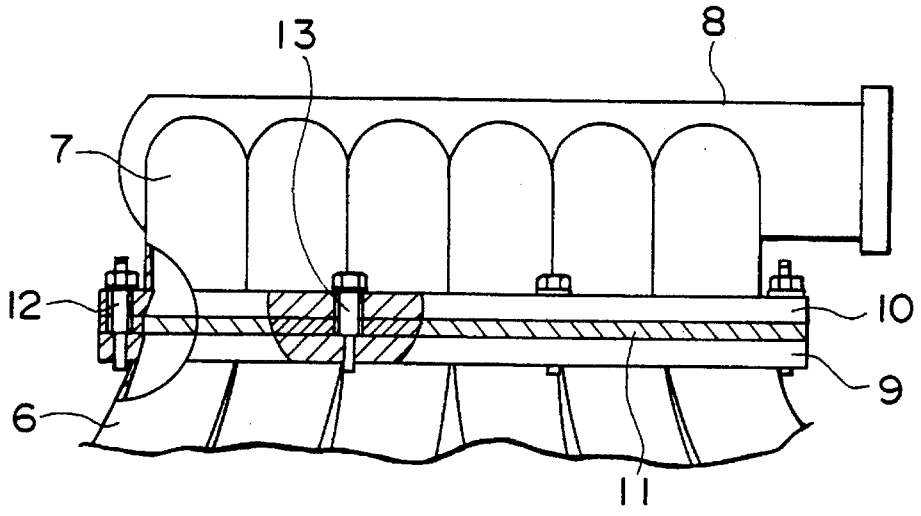
FIG. 7 is similar to FIG. 5, but showing the third embodiment of this invention.
Figure 8:
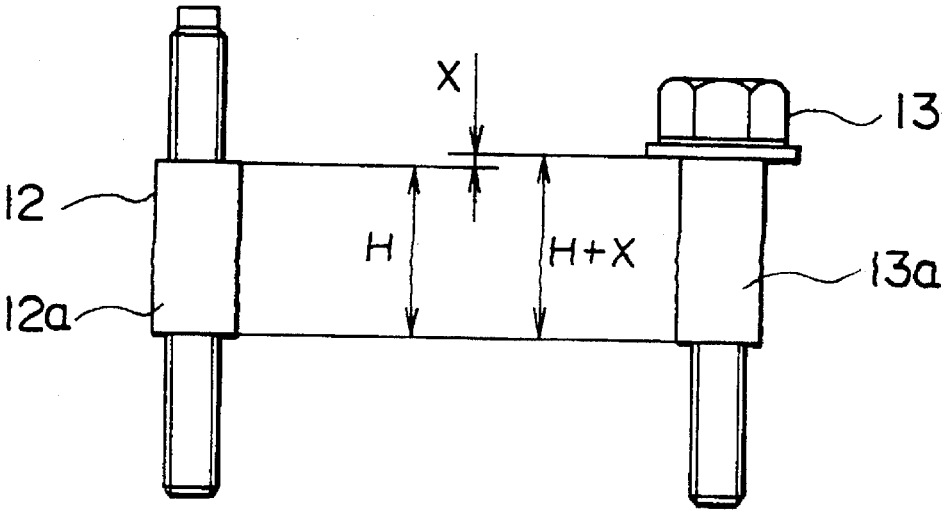
FIG. 8 is a side view of a stud bolt and a stepped bolt according to the third embodiment of this invention.

FIGS. 6–8 show a third embodiment of this invention.

According to this embodiment, the rubber washer 15 is removed from the stepped bolt 13, and the neck 13*a* of the bolt 13 is made longer by an amount X than the size H of the screw 12*a* of the bolt 12, in order to increase the compression of the gasket 11 by the stud bolt 12.

Due to this size difference X, the reaction to compression of the gasket 11 in the vicinity of the bolt 13 that has a large vibration, does not become large, and a large stress is prevented from acting on the bolt 13. On the other hand, the gasket 11 that is highly compressed in the vicinity of the bolt 12 has a high friction, and definitively prevents displacement of the flanges 9 and 10 in the shear direction so as to provide good sealtightness and high reliability.

The embodiments of this invention in which an exclusive property or privilege is claimed are defined as follows:

1. An intake manifold for a multi-cylinder engine, said engine having a cylinder head, intake ports on said cylinder head, and a collector disposed above said cylinder head, with said intake manifold connecting said collector to said intake ports, comprising:

a lower branch having a plurality of first pipe elements, said first pipe elements having lower ends connected to said intake ports and free ends opposite said lower ends of said first pipe elements being arranged in a row;

an upper branch having a plurality of second pipe elements, said second pipe elements having an overhanging portion on one side of said cylinder head and having upper ends connected to said collector and free ends opposite said upper ends of said second pipe elements being arranged in a row;

a flange formed around said first pipe elements at said free ends of said first pipe elements;

a flange formed around said second pipe elements at said free ends of said second pipe elements;

an elastic seal member between said flanges, wherein said flanges each have mounting holes consisting of a first set of holes at positions adjacent two ends of said respective flanges and a second set of holes adjacent an edge of said respective flanges at positions offset with respect to an imaginary line joining said first holes and on an opposite side of said overhanging portion, wherein said rows of said lower and upper ends of said first and second pipe elements are arranged between said first holes; and bolts joining said flanges through said first and second holes.

2. An intake manifold as defined in claim 1, wherein a deformation of said seal member due to the bolts applied to the first holes is set larger than the deformation of said seal member due to the bolts applied to the second holes.

3. An intake manifold as defined in claim 1, wherein said first holes are formed at positions displaced toward said collector away from an imaginary center line formed by said row.

4. An intake manifold as defined in claim 2, wherein the bolts applied to said first holes are stud bolts, and the bolts applied to said second holes are stepped bolts.

5. An intake manifold as defined in claim 4, further comprising a washer made of an elastic member inserted between said stepped bolt and said flange.

6. An intake manifold as defined in claim 5, further comprising a lip provided respectively on each of said flanges, said lip being located on the opposite side of said overhanging portion, wherein said stepped bolts are located on said lip.

* * * * *